US011732502B2

(12) United States Patent
Gascon Garralaga

(10) Patent No.: US 11,732,502 B2
(45) Date of Patent: Aug. 22, 2023

(54) METHOD AND SYSTEM FOR OPENING LOCKS

(71) Applicant: Pumpam Solutions S.L., Saragossa (ES)

(72) Inventor: Jaime Bernardo Gascon Garralaga, Saragossa (ES)

(73) Assignee: Pumpam Solutions S.L., Saragossa (ES)

( * ) Notice: Subject to any disclaimer, the term of this patent is extended or adjusted under 35 U.S.C. 154(b) by 380 days.

(21) Appl. No.: 17/261,921

(22) PCT Filed: Jul. 19, 2019

(86) PCT No.: PCT/ES2019/070507
§ 371 (c)(1),
(2) Date: Jan. 21, 2021

(87) PCT Pub. No.: WO2020/021139
PCT Pub. Date: Jan. 30, 2020

(65) Prior Publication Data

US 2021/0310276 A1 Oct. 7, 2021

(30) Foreign Application Priority Data

Jul. 24, 2018 (ES) ..... ES201830748

(51) Int. Cl.
*E05B 19/20* (2006.01)

(52) U.S. Cl.
CPC ..... *E05B 19/20* (2013.01)

(58) Field of Classification Search
CPC ..... E05B 9/20; E05B 9/205
See application file for complete search history.

(56) References Cited

U.S. PATENT DOCUMENTS 1,944,006 A * 1/1934 Hanflig ..... E05B 19/205 81/463
2,309,677 A 2/1943 Segal
(Continued)

FOREIGN PATENT DOCUMENTS

WO WO 2020/021139 1/2020

OTHER PUBLICATIONS

International Search Report and the Written Opinion dated Jan. 3, 2020 From the International Searching Authority Re. Application No. PCT/ES2019/070507. (12 Pages).

*Primary Examiner* — Christopher J Boswell

(57) ABSTRACT

The invention relates to a method for opening locks, designed for use in a lock equipped with a cylinder, rotor, and inlet channel for an opening key, comprising the following steps:

a. Positioning and pre-insertion into the inlet channel of a tool having a geometry which is compatible with the opening key, and said positioning being up to only one region of said tool corresponding to the tip thereof, and in a manner initially similar to inserting the same opening key into said inlet channel.

b. Pressing by means of an impingement gun on the same tool in the inlet channel, after the positioning thereof.

c. Penetration of said tool in the inlet channel as a consequence of the previous pressing, and interlocking in the inlet channel, occupying a space similar to the corresponding opening key.

d. Breaking the cylinder and/or rotor as a consequence of the previous penetration and interlocking.

e. Opening of the lock.

15 Claims, 11 Drawing Sheets

(56) References Cited

U.S. PATENT DOCUMENTS

| | | | | | |
|---|---|---|---|---|---|
| 2,565,254 | A * | 8/1951 | Miskill | E05B 19/20 | 70/394 |
| 4,156,375 | A * | 5/1979 | Crasnianski | E05B 19/20 | 81/15.9 |
| 5,196,647 | A * | 3/1993 | Majors | E05B 19/20 | 102/302 |
| 5,237,613 | A | 8/1993 | Berry et al. | | |
| 5,276,951 | A | 1/1994 | Gluszek | | |
| 5,987,946 | A * | 11/1999 | Watts | E05B 19/20 | 408/1 R |
| 6,138,486 | A * | 10/2000 | Hughes | E05B 19/20 | 70/494 |
| 6,725,697 | B1 * | 4/2004 | Leadon | B23B 41/00 | 408/79 |
| 6,931,898 | B2 * | 8/2005 | Wendt | E05B 19/20 | 70/397 |
| 8,001,816 | B2 * | 8/2011 | Black | E05B 19/20 | 70/394 |
| 9,440,318 | B1 * | 9/2016 | Tibbets | E05B 19/20 | |
| 2009/0139288 | A1 * | 6/2009 | Pettey | E05B 19/20 | 70/378 |

* cited by examiner

METHOD AND SYSTEM FOR OPENING LOCKS

RELATED APPLICATIONS

This application is a National Phase of PCT Patent Application No. PCT/ES2019/070507 having International filing date of Jul. 19, 2019, which claims the benefit of priority of Spanish Patent Application No. P201830748 filed on Jul. 24, 2018. The contents of the above applications are all incorporated by reference as if fully set forth herein in their entirety.

FIELD AND BACKGROUND OF THE INVENTION

The object of this invention application is to register a method and system for opening locks, which incorporates notable innovations and advantages over the techniques used until now.

More specifically, the invention proposes the development of a method and system for opening locks, which due to the particular arrangement thereof, enables locks to be opened much more easily, quickly and effectively in relation to the techniques used until now.

Different techniques used for opening locks with a cylinder, especially those used by locksmiths working for the police or other security agencies, firefighters, etc. are known in the current state of the art.

However, the different techniques known until now are either very sensitive to the protrusion of the cylinder with respect to the door, or require the use of additional screws and iron plates, as well as needing personnel with special expertise and skill in the sector of the art, in addition to requiring too much time in the execution thereof.

The present invention helps to solve and resolve the present problem, since it enables locks to be opened much more easily, quickly and effectively in relation to the techniques used until now.

SUMMARY OF THE INVENTION

The present invention has been developed with the aim of providing a method for opening locks, designed to be used in a lock equipped with a cylinder, rotor or tumbler, and an inlet channel into the rotor for an opening key, which is essentially characterised in that it comprises the following steps:

a. Positioning and pre-insertion into the inlet channel of the lock of a tool designed for said purpose and said tool having a geometry which is compatible with the opening key in relation to the same inlet channel, and said positioning and pre-insertion being up to only one region of said tool corresponding to the tip thereof, and in a manner initially similar to inserting the same opening key into said inlet channel.
b. Pressing by means of an impingement gun on the same tool in the inlet channel, after the positioning and pre-insertion thereof.
c. Penetration of said tool into the inlet channel as a consequence of the previous pressing, and interlocking in the inlet channel, occupying a space similar to the corresponding opening key in the same inlet channel.
d. Breaking the cylinder and/or rotor as a consequence of the previous penetration and interlocking.
e. Opening of the lock.

Additionally, in the method for opening locks, after the penetration of the tool and the interlocking thereof in the inlet channel, the tool is tightened/rotated around the axial axis thereof.

Preferably, in the method for opening locks, the tool is tightened/rotated by means of a suitable tightening/rotating instrument.

Alternatively, in the method for opening locks, after breaking the cylinder and/or the rotor, the cylinder and/or the rotor is extracted.

Preferably, in the method for opening locks, the extraction takes place by means of a suitable extraction instrument.

Additionally, in the method for opening locks, the impingement gun is one of the instruments of the type commonly used for fastening or anchoring nails.

A system for opening locks, designed to be used in a lock equipped with a cylinder, rotor or tumbler, and an inlet channel in the rotor for an opening key, suitable for carrying out a method of the present invention, which is essentially characterised in that it comprises a tool with a geometry compatible with the opening key in relation to the same inlet channel and equipped with a tip and an axial axis, and an impingement gun enabled for the pressing, penetration and interlocking of the tool in the inlet channel of the lock.

Preferably, the system for opening locks comprises a tightening/rotating instrument enabled for tightening/rotating the tool around the axial axis thereof.

Alternatively, in the system for opening locks, the tightening/rotating instrument comprises a wrench or similar.

Alternatively, the system for opening locks comprises an extraction instrument enabled for extracting the cylinder and/or the rotor.

Alternatively, in the system for opening locks, the extraction instrument comprises a lever or crowbar or similar.

Alternatively, in the system for opening locks, the tool has an end opposite from the tip thereof and enabled for tightening/rotating the same tool around the axial axis thereof by means of the tightening/rotating instrument.

Alternatively, in the system for opening locks, the tool has a stop arranged in the region opposite from the tip thereof.

Preferably, in the system for opening locks, the tool is made of steel, with the following composition:

| Content (%) | | | | | | |
|---|---|---|---|---|---|---|
| C | $Si_{max.}$ | Mn | $P_{max.}$ | $S_{max.}$ | Cr | Mo |
| 0.38-0.45 | 0.40 | 0.60-0.90 | 0.035 | 0.035 | 0.90-1.20 | 0.15-0.30 |
| Permissible deviations between the analysis of the product and the values specified for the casting analysis | | | | | | |
| C | Si | Mn | P | S | Cr | Mo |
| ±0.02 | +0.03 | ±0.04 | +0.005 | +0.005 | ±0.05 | ±0.03 |

Additionally, in the system for opening locks, the impingement gun is one of the instruments of the type commonly used for fastening or anchoring nails.

Alternatively, in the system for opening locks, the impingement gun is detonating or powder-actuated.

Alternatively, in the system for opening locks, the impingement gun uses gas.

Alternatively, in the system for opening locks, the impingement gun is electric.

Alternatively, in the system for opening locks, the impingement gun is pneumatic with air or oxygen.

Alternatively, in the system for opening locks, the impingement gun is the result of introducing some modification and/or adaptation in an impingement gun of the type commonly used for fastening or anchoring nails.

A use of an impingement gun for opening a lock, which is essentially characterised in that the impingement gun is of the type commonly used for fastening or anchoring nails.

Alternatively, in the use of an impingement gun for opening a lock, the impingement gun is detonating or powder-actuated.

Alternatively, in the use of an impingement gun for opening a lock, the impingement gun uses gas.

Alternatively, in the use of an impingement gun for opening a lock, the impingement gun is electric.

Alternatively, in the use of an impingement gun for opening a lock, the impingement gun is pneumatic with air or oxygen.

Thanks to the present invention, locks are able to be opened much more easily, quickly and effectively in relation to the techniques used until now, and it is very useful especially when used by locksmiths working for the police or other security agencies, firefighters, etc.

Other features and advantages of the method and system for opening locks, and use of an impingement gun for said purpose will be apparent from the description of a preferred, but not exclusive, embodiment illustrated by way of non-limiting example in the accompanying drawings, in which:

DESCRIPTION OF A SPECIFIC EMBODIMENTS OF THE INVENTION

Figure 1:
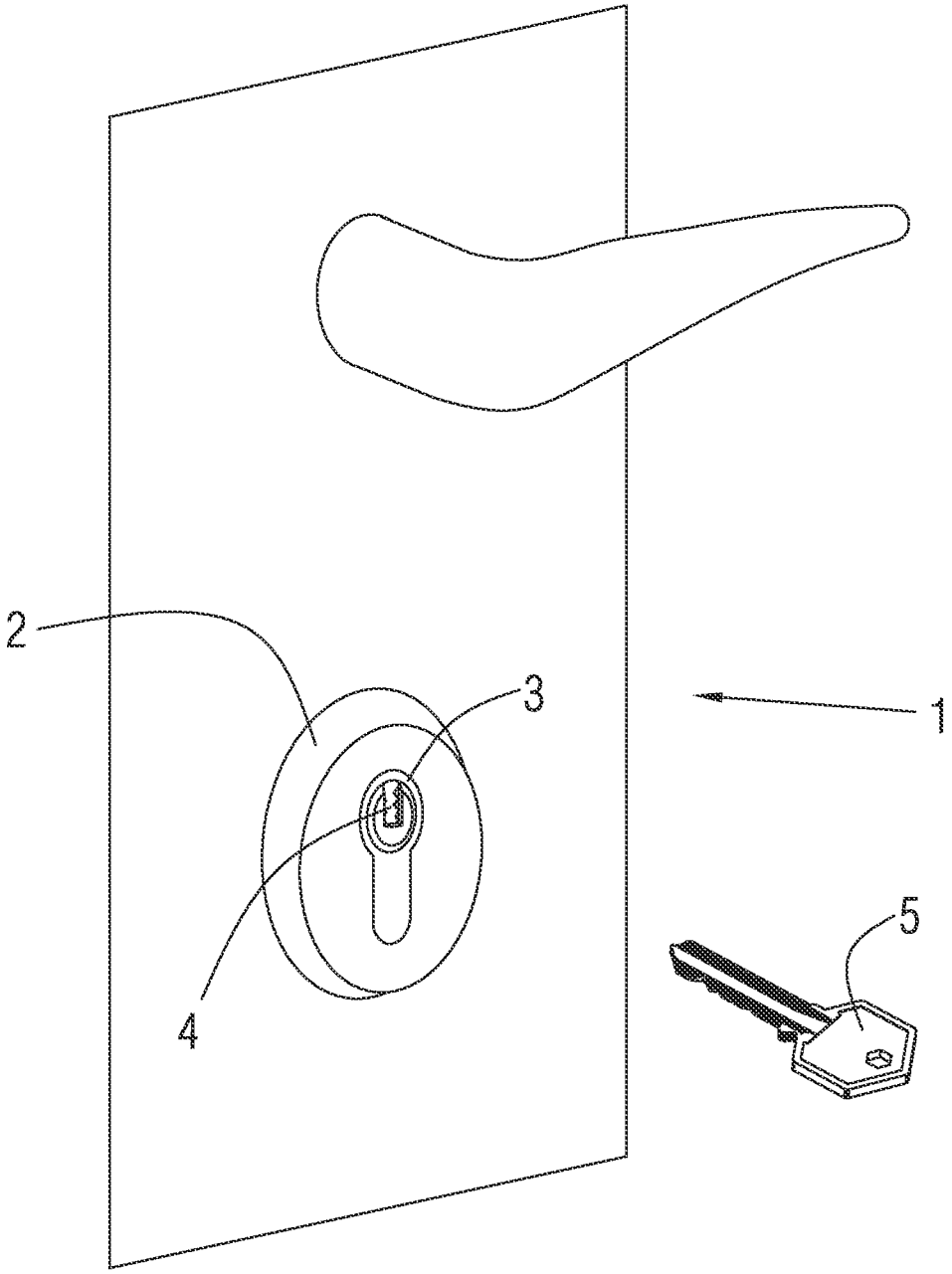
FIG. 1 is a schematic view of a lock of the type commonly used in the method and system for opening locks, of the present invention.

The method for opening locks of the present invention is intended for use in a lock 1 equipped with a cylinder 2, rotor 3 or tumbler, and an inlet channel 4 in the rotor 3 of an opening key 5, schematically shown in FIG. 1 and of the types already known in the state of the art.

Figure 2:
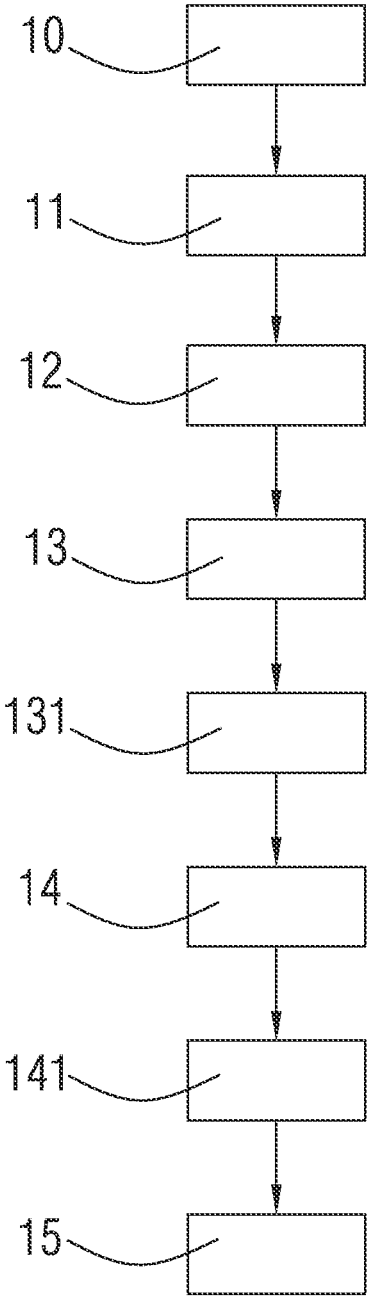
FIG. 2 is a schematic view of a preferred embodiment of the method for opening locks of the present invention.

Already in accordance with the invention, and as schematically shown in FIG. 2, the method for opening locks of the proposed invention successively comprises the following steps.

First, positioning 10 and pre-insertion into the inlet channel 4 of the lock 1 of a tool 6 designed for said purpose is carried out from the outside of the lock 1 in question. Therefore, said tool 6 has a geometry which is compatible with the very opening key 5 with respect to the same inlet channel 4.

Said positioning 10 and pre-insertion of the tool 6 is performed up to only one region of said tool 6 corresponding to the tip 61 thereof, and in a manner initially similar to inserting the same opening key 5 into said inlet channel 4.

A pressing 11 is then performed by means of an impingement gun 7, or other suitable means, on the same tool 6 in the inlet channel 4, after the positioning 10 and pre-insertion thereof.

In different preferred embodiments, it can be very useful if the impingement gun 7 is of the type commonly used for fastening or anchoring nails.

As a consequence of the pressing 11 by means of the impingement gun 7, a penetration 12 of most of said tool 6 is produced in the inlet channel 4, and a consequent interlocking 13 of the tool 6 in the same inlet channel 4, occupying a space similar to the corresponding opening key 5 in the same inlet channel 4.

In the described method, after the penetration 12 of most of the tool 6 in the inlet channel 4 and the consequent interlocking 13 thereof, it may sometimes be necessary to tighten/rotate 131 the very tool 6 around the axial axis 62 thereof by means of a suitable tightening/rotating instrument, for example a wrench, and acting on the same tool 6 at the end 63 thereof protruding from the inlet channel 4 after the interlocking 13.

Figure 3:
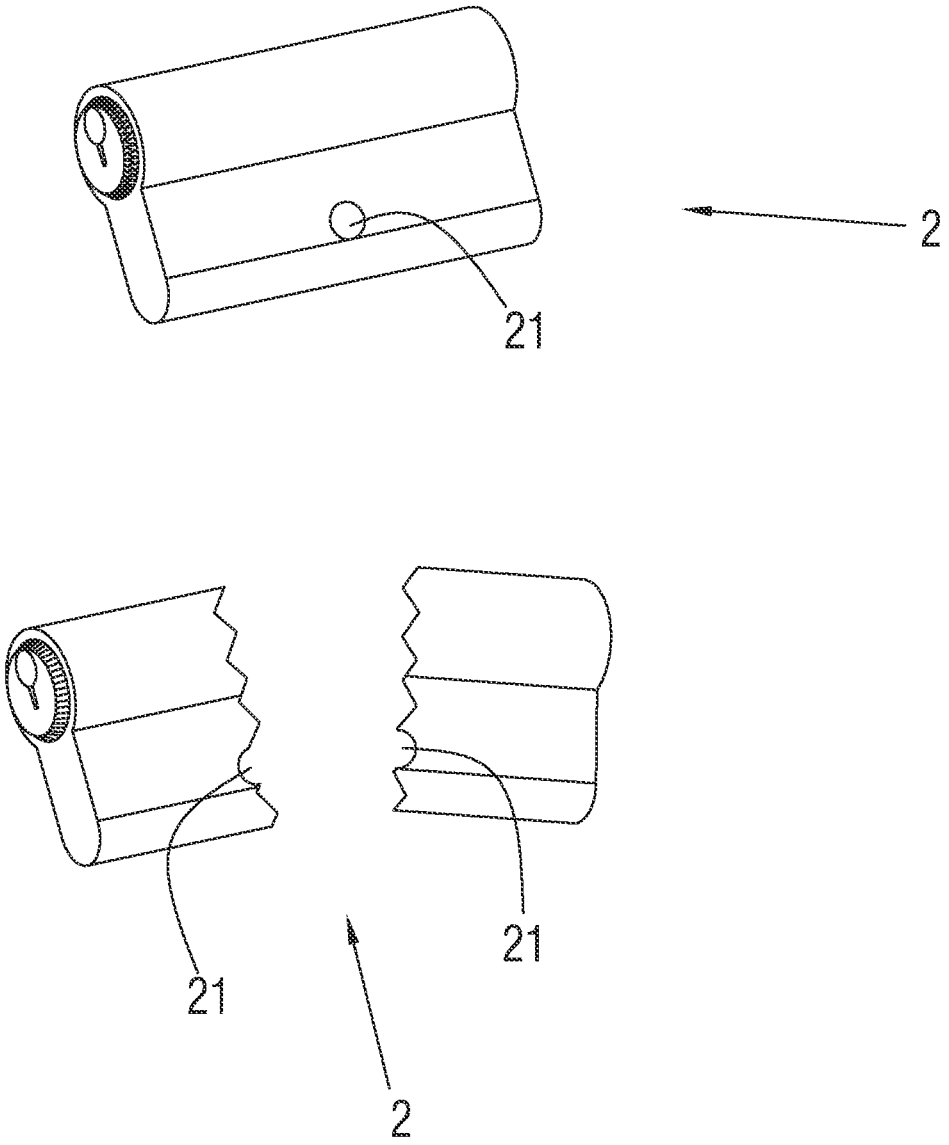
FIG. 3 is a schematic view of breaking the cylinder of a lock in the method and system for opening locks of the present invention.

The aforementioned interlocking 13 of the tool 6 in the inlet channel 4 consequently breaks 14 the cylinder 2, approximately in half and in the weakest region thereof due to the existence of a hole 21 for attaching the very cylinder 2 in the same lock 1 by means of threading, as shown schematically in FIG. 3 before and after the breaking 14, and sometimes with the help of the tightening/rotating 131 referred to above. The half of the cylinder 2 on the outside of the lock 1 can then be easily and manually removed, and the other half on the inside of the lock 1 shoots out of the same lock 1.

Figure 4:
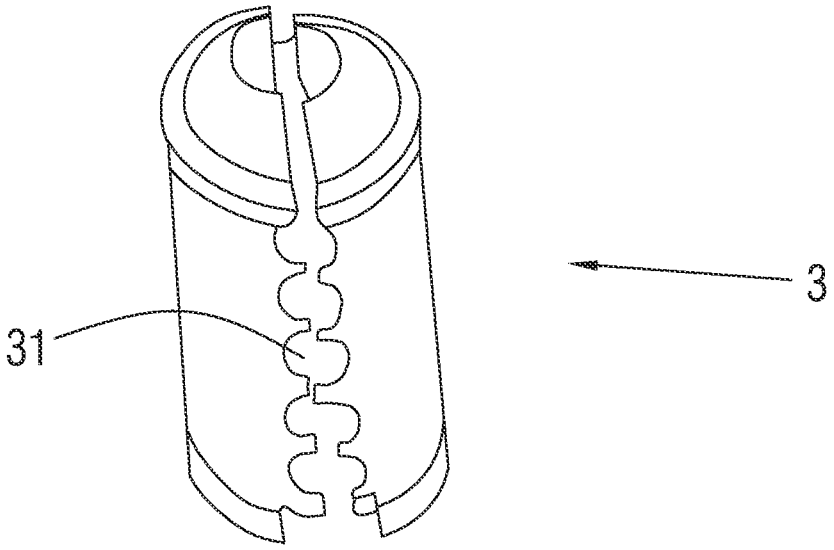
FIG. 4 is a schematic view of breaking the rotor of a lock in the method and system for opening locks of the present invention.

On other occasions, as shown schematically in FIG. 4, after the interlocking 13 of the tool 6 in the inlet channel 4, the breaking 14 of the rotor 3 takes place longitudinally and along the holes 31 wherein the pins making up the combination of the lock 1 are housed, in the case, for example, of a flat opening key 5.

After breaking 14 the cylinder 2 and/or rotor 3, the opening 15 of the lock 1 can be performed.

On other occasions, after breaking 14 the cylinder 2 or the rotor 3 and/or if the aforementioned tightening/rotation 131 was not sufficient, an extraction 141 of the cylinder 2 or the rotor 3 is necessary by means of a suitable extraction instrument, such as a lever or a crowbar, then proceeding with the opening 15 of the lock 1.

The invention also includes a system for opening locks, designed for use in the same lock 1 schematically shown in FIG. 1 and of the type already known in the state of the art, which is provided with a cylinder 2, a rotor 3 or tumbler, and an inlet channel 4 in the rotor 3 for an opening key 5. Said system for opening locks is suitable for carrying out the method described above.

The system for opening locks of the proposed invention comprises a tool 6 and an impingement gun 7 or other suitable means, which were already initially referred to in the description of the preceding method.

The tool 6 has a geometry which is compatible with the opening key 5, in order to be able to be inserted through the inlet channel 4 of the very lock 1. Therefore, the tool 6 can have different geometries, adapting to different types of inlet channels 4 according to different locks 1.

Figure 5:
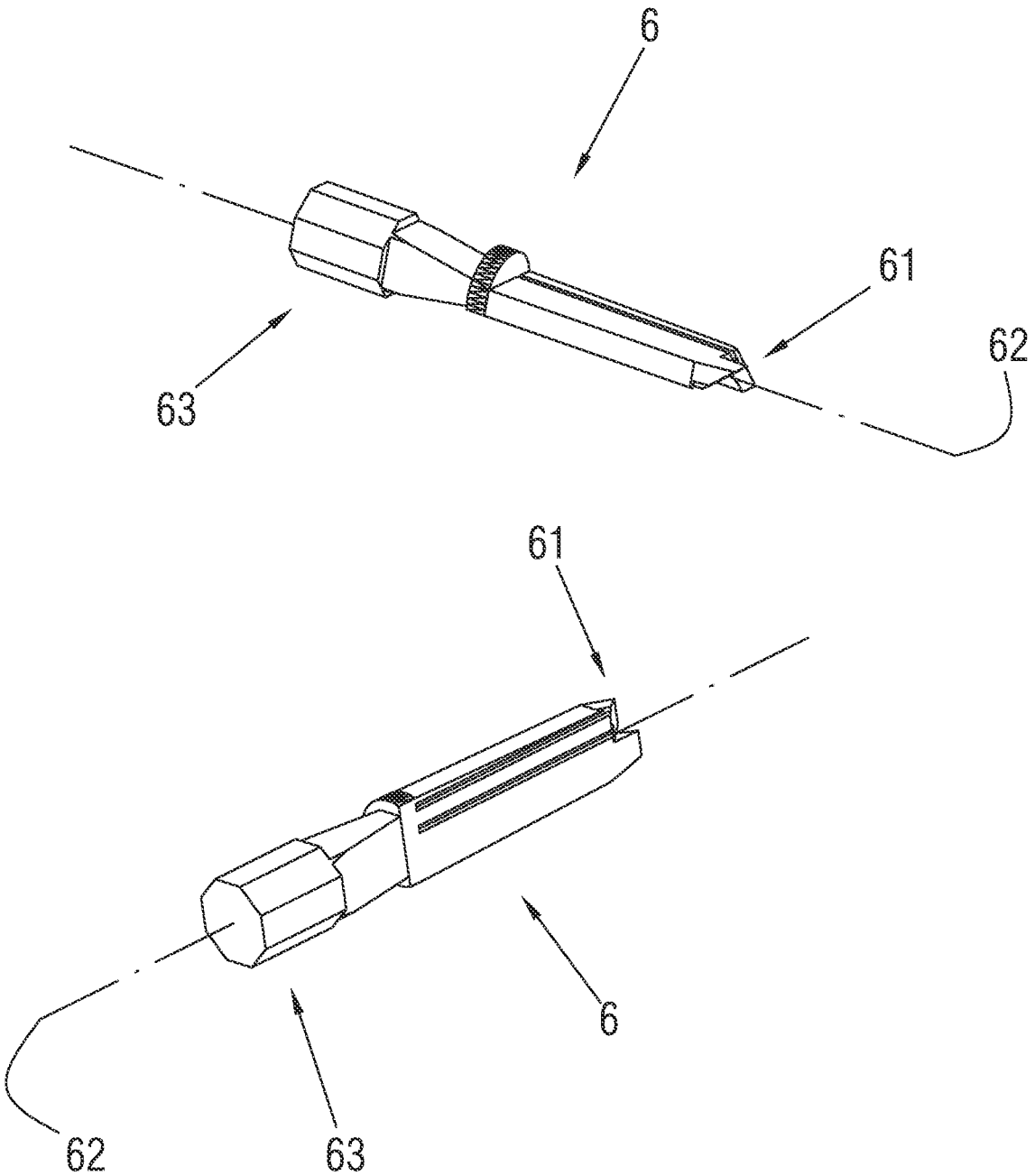
FIGS. 5 and 6 are schematic views from different perspectives of the tool used in a preferred embodiment of the method and system for opening locks of the present invention.
Figure 6:
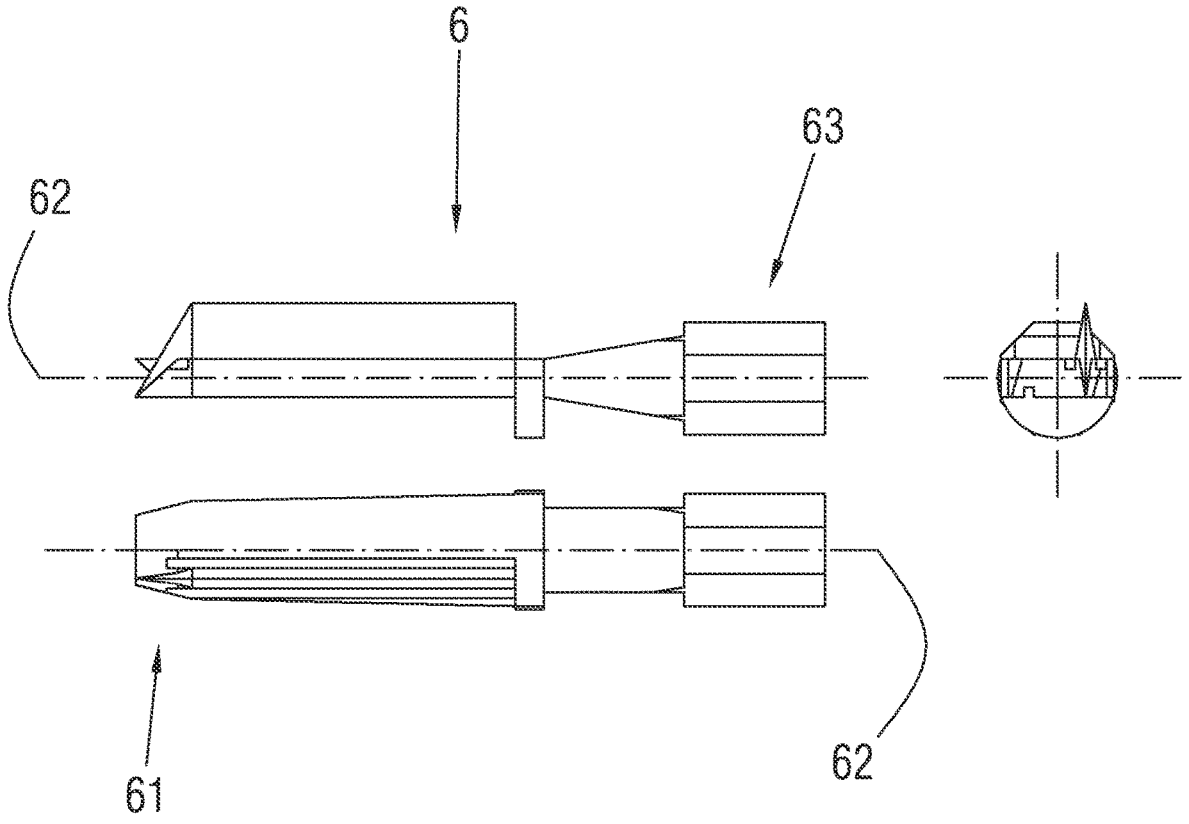

FIGS. 5 and 6 schematically show a possible geometry of the tool 6, in perspective view and multiview projection, respectively. In this case, the tool 6 better adapts to an opening key 5 known as a dimple key, and consequently breaks 14 the rotor 3, as shown in FIG. 4.

Figure 7:
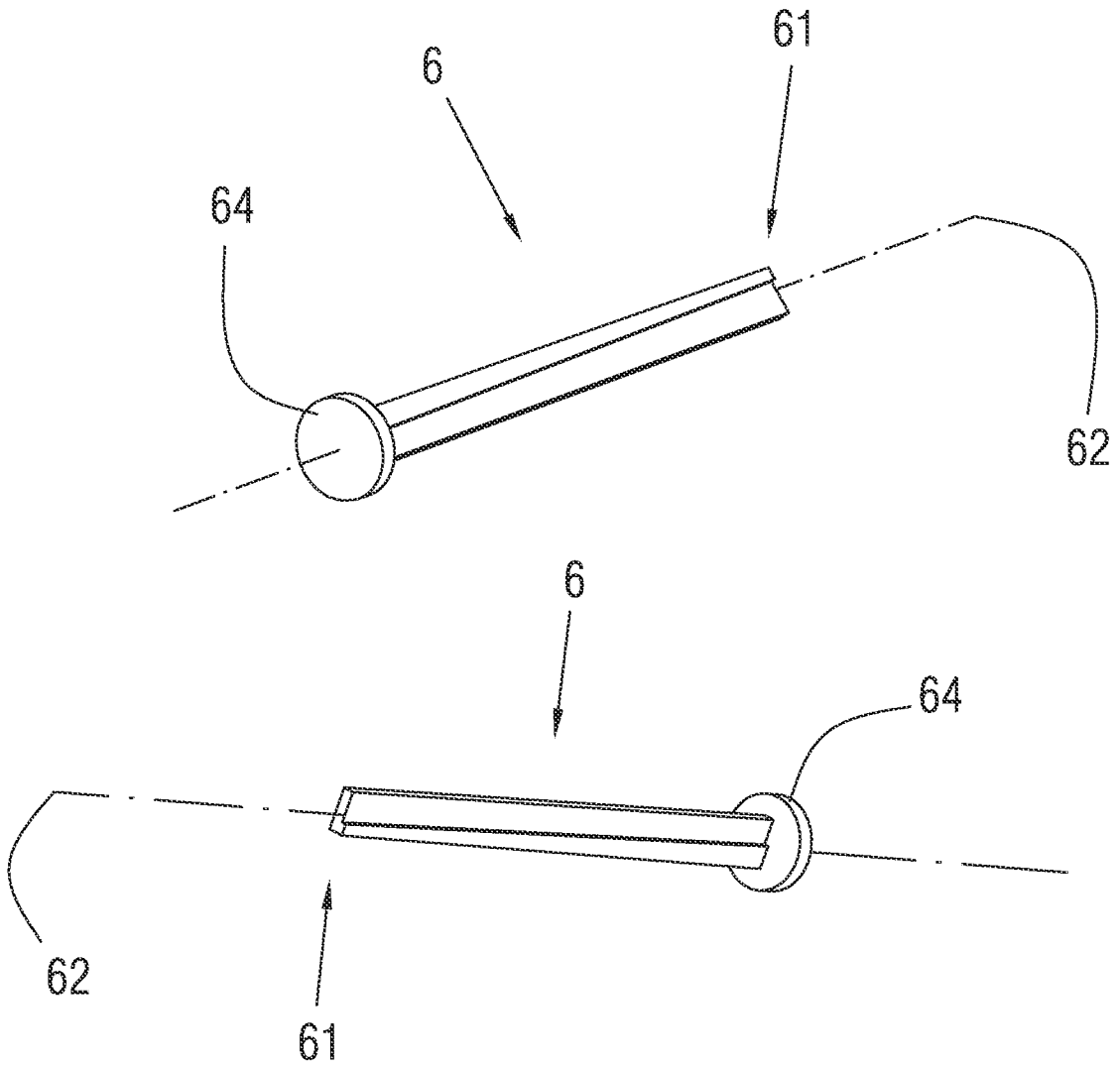
FIGS. 7 and 8 are schematic views from different perspectives of the tool used in another preferred embodiment of the method and system for opening locks of the present invention.
Figure 8:
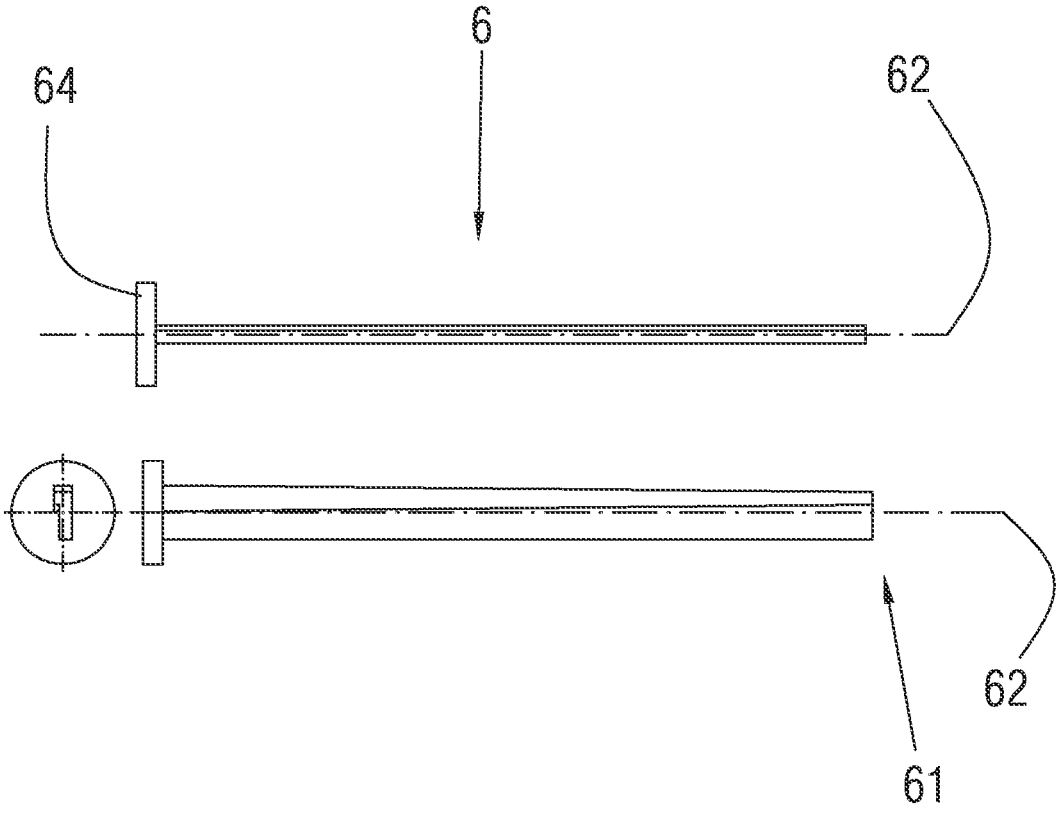

FIGS. 7 and 8 schematically show another possible geometry of the tool 6, in perspective view and multiview projection, respectively. In this case, the manoeuvre is for removal, and the tool 6 is much more universal and more adaptable to different types of opening keys 5, and consequently breaks 14 the cylinder 2, as shown in FIG. 3.

Figure 9:
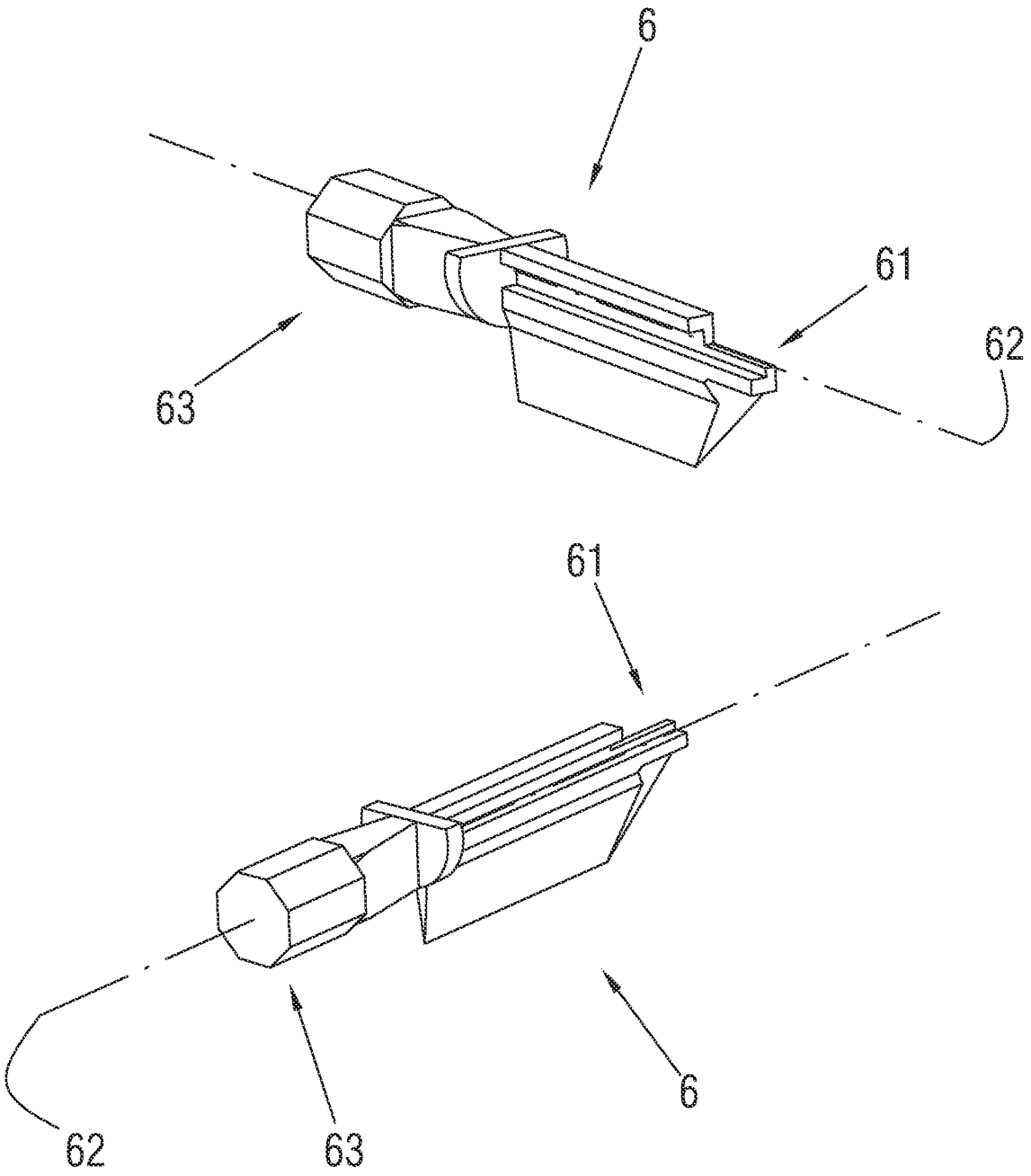
FIGS. 9 and 10 are schematic views from different perspectives of the tool used in another preferred embodiment of the method and system for opening locks of the present invention.
Figure 10:
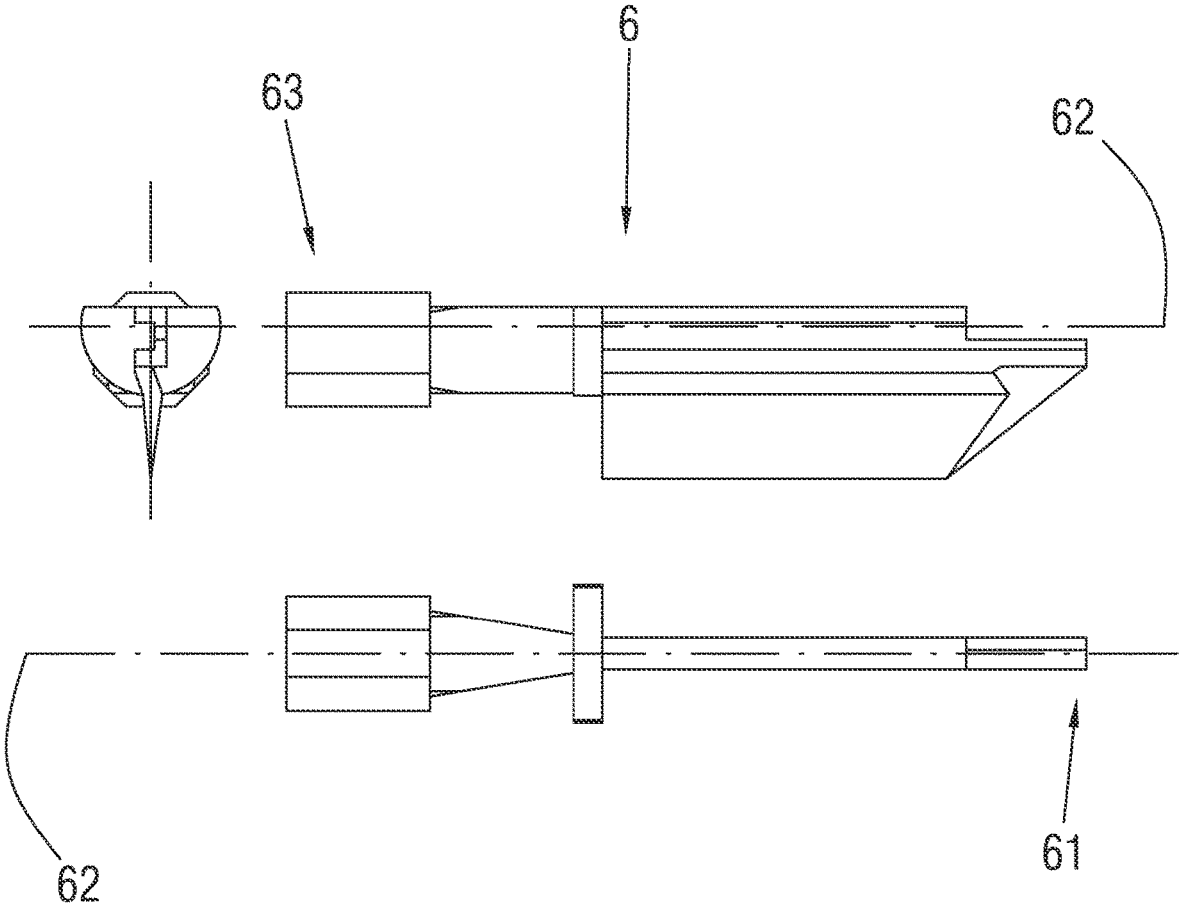

FIGS. 9 and 10 schematically show another possible geometry of the tool 6, in perspective view and multiview projection, respectively. In this case, the tool 6 better adapts to an opening key 5 known as a flat key, and consequently breaks 14 the rotor 3, as shown in FIG. 4.

The impingement gun 7 is enabled for the pressing 11 or driving and interlocking 13 of the tool 6 in the inlet channel 4 of the lock 1, when the tool 6 has already been previously positioned 10 for said purpose.

Figure 11:
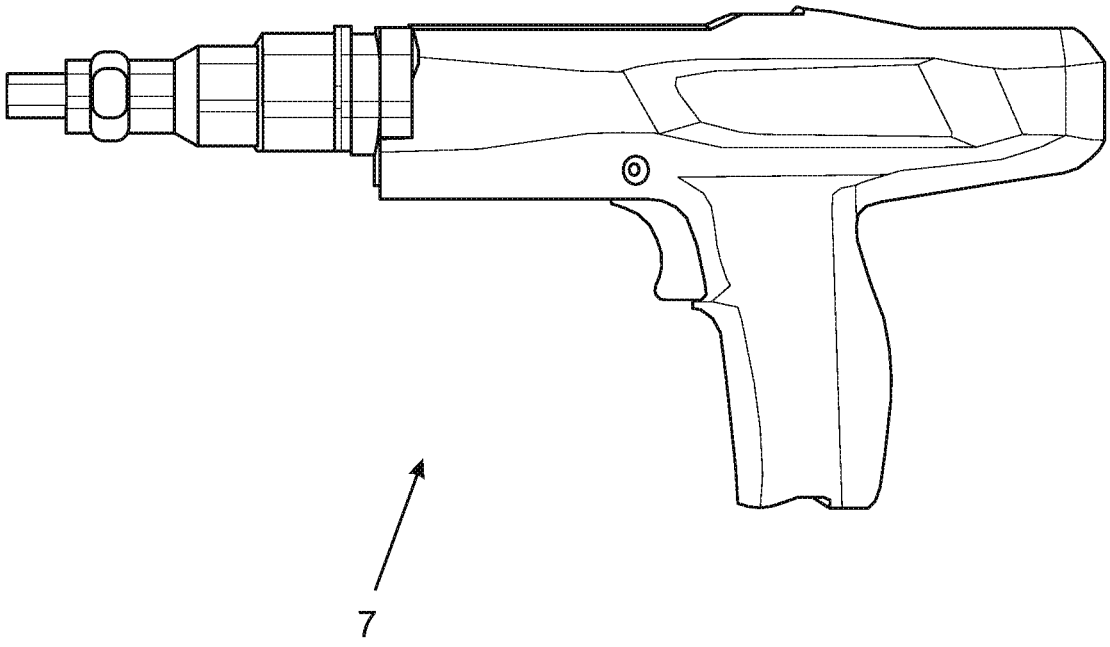
FIG. 11 is a schematic view of an impingement gun used in a preferred embodiment of the method and system for opening locks of the present invention.

Said impingement gun 7 may have different arrangements. It can be very useful for the impingement gun 7 to correspond to the type commonly used for fastening or anchoring nails, for example detonating or powder-actuated, using gas, being electric, pneumatic with air or oxygen, etc., such as the one shown in FIG. 11.

The impingement gun 7 of the system for opening locks of the invention can even be the result of introducing some modification and/or adaptation in an impingement gun of the type commonly used in fastening or anchoring nails.

The system for opening locks of the invention can also comprise a tightening/rotating instrument, for example a wrench or similar not shown in the drawings since it is known in the state of the art, and enabled and/or suitable for tightening/rotating 131 the tool 6 at the end 63 thereof protruding from the inlet channel 4 and around the axial axis 62 thereof.

Said end 63 may be in turn adapted with an octagonal shape for the tightening/rotating 131 thereof, for example by means of a wrench, for example shown in FIGS. 5, 6 and 9, 10. This helps break 14 the cylinder 2 and/or rotor 3 in the method explained previously.

In other preferred embodiments, such as the one shown in FIGS. 7 and 8, the tool 6 may have a stop 64 arranged in the region opposite from the tip 61 thereof. With this, the penetration 12 of the tool 6 in the inlet channel 4 is able to be limited up to said stop 64, after the pressing 11 by means of the impingement gun 7. If there is difficulty, this can also help in the subsequent removal of the same tool 6 by means of a lever or crowbar.

The tool 6 must be made with a composition suitable for the function thereof, for example from adequately tempered and quenched steel.

A suitable composition of the steel of the tool 6 in an analysis on casting is shown in the following table.

| Content (%) | | | | | | |
|---|---|---|---|---|---|---|
| C | $Si_{max.}$ | Mn | $P_{max.}$ | $S_{max.}$ | Cr | Mo |
| 0.38-0.45 | 0.40 | 0.60-0.90 | 0.035 | 0.035 | 0.90-1.20 | 0.15-0.30 |
| Permissible deviations between the analysis of the product and the values specified or the casting analysis | | | | | | |
| C | Si | Mn | P | S | Cr | Mo |
| ±0.02 | +0.03 | ±0.04 | +0.005 | +0.005 | ±0.05 | ±0.03 |

In other preferred embodiments, the system for opening locks of the invention may also comprise an extraction instrument previously referred to in the description of the method, for example a lever, crowbar or similar and not shown in the drawings since it is known in the state of the art.

Said extraction instrument is enabled and is suitable for the extraction 141 of the cylinder 2 and/or the rotor 3, for example if the aforementioned tightening/rotation 131 was not sufficient. This circumstance could be likely to happen in the case of using a tool 6 with a geometry like the one shown in FIGS. 5, 6 and 9, 10.

The method and system for opening locks, and use of an impingement gun for said purpose of the present invention involves considerable innovation and advantages or improvements, with respect to current instruments and techniques offered by the state of the art, and operating methods when working with said instruments.

In the methods and systems known in the state of the art, a self-drilling screw and the threading thereof in the cylinder 2 are required, which requires expertise and skill, and furthermore the extraction manoeuvre is necessary.

In the proposed invention, the manoeuvre can be a driving or removing motion, and since it lacks a screwing motion it is much faster, more efficient and easier when applied, and requires a much lower level of expertise and skill.

The present invention is completely innovative, since it simultaneously uses the tool 6 with the impingement gun 7, without said impingement gun 7 being necessarily and initially designed for said purpose.

The actuation time is also much shorter compared to all the instruments and techniques known in the state of the art, which use methods of screwing, unlike the present invention which uses elements for driving or removing and cutting, thus reducing the degree of skill necessary for the person using it.

In the proposed invention, the breaking 14 of the cylinder 2 and/or the rotor 3, without needing to break almost all the keyplates used in the state of the art, is a manoeuvre with a significant advantage over the state of the art known as an "extractor hood", which is not an easy manoeuvre, since it is common for the screws to break, which requires more time and expertise.

Said "extractor hood" manoeuvre is only suitable for Ezcurra keyplates and not in all situations, and it depends on how the keyplate is placed and the model of cylinder, which is often not suitable.

The proposed invention is extraordinarily effective, for example in the case of six-pin safety cylinders, and also in those comprising balls and discs actuated by springs, gravity and magnets, as well as in most keyplates, without needing to break the keyplates, with a much shorter actuation time, needing less expertise and ability.

In the case of a tool 6 with a geometry like the one shown in FIGS. 5, 6 and 9, 10, the penetration 12 and interlocking 13 of the same tool 6 in the inlet channel 4 of the rotor 3 can perfectly cause the pins of the rotor 3, which make up the combination of the lock 1, to come out and fall even simply due to gravity and without these breaking.

The proposed invention is very well adapted for locks 1 with multiple types of cylinders 2, such as cylinders 2 with a European, oval, round, Swiss profile, etc.

The present invention is also perfectly adapted to locks 1 with multiple types of opening keys 5, such as flat, dimpled, rounded, magnetic, solid, hollow, cruciform, tubular keys, etc.

The details, shapes, dimensions and other accessory elements, as well as the materials used in the manufacture of the method and system for opening locks, and use of an impingement gun for said purpose of the invention, may be suitably substituted for others which are technically equivalent, and do not diverge from the essential nature of the invention nor from the scope defined by the claims included below.

The invention claimed is:

1. A method for opening locks, designed for use in a lock (1) equipped with a cylinder (2), rotor (3) or tumbler, and inlet channel (4) in the rotor (3) for an opening key (5), characterised in that it comprises the following steps:

a. Positioning (10) and pre-insertion into the inlet channel (4) of the lock (1) of a tool (6) designed for said purpose and said tool (6) having a geometry which is compatible with the opening key (5) in relation to the same inlet channel (4), and said positioning (10) and pre-insertion being up to only one region of said tool (6) corresponding to the tip (61) thereof, and in a manner initially similar to inserting the same opening key (5) into said inlet channel (4);

b. Pressing (11) by means of an impingement gun (7) on the same tool (6) in the inlet channel (4), after the positioning (10) and pre-insertion thereof;

c. Penetration (12) of said tool (6) into the inlet channel (4) as a consequence of the previous pressing (11), and interlocking (13) in the inlet channel (4), occupying a space similar to the corresponding opening key (5) in the same inlet channel (4);

d. Breaking (14) the cylinder (2) and/or rotor (3) as a consequence of the previous penetration (12) and interlocking (13);

e. Opening (15) of the lock (1).

2. The method for opening locks according to claim 1, characterised in that after the penetration (12) of the tool (6) and the interlocking (13) thereof in the inlet channel (4), the tool (6) is tightened/rotated (131) around the axial axis thereof (62).

3. The method for opening locks according to claim 2, characterised in that the tool (6) is tightened/rotated (131) by means of a suitable tightening/rotating instrument.

4. The method for opening locks according to claim 1, characterised in that after breaking (14) the cylinder (2) and/or the rotor (3), the cylinder (2) and/or the rotor (3) is extracted (141).

5. The method for opening locks according to claim 4, characterised in that the extraction (141) takes place by means of a suitable extraction instrument.

6. The method for opening locks according to claim 1, characterised in that the impingement gun (7) is of the type commonly used for fastening or anchoring nails.

7. A system for opening locks, designed to be used in a lock (1) equipped with a cylinder (2), rotor (3) or tumbler, and an inlet channel (4) in the rotor (3) for an opening key (5), suitable for carrying out the method of claim 1, characterised in that it comprises a tool (6) with a geometry compatible with the opening key (5) in relation to the same inlet channel (4) and equipped with a tip (61) and an axial axis (62), and an impingement gun (7) enabled for the pressing (11), penetration (12) and interlocking (13) of the tool (6) in the inlet channel (4) of the lock (1).

8. The system for opening locks according to claim 7, characterised in that it comprises a tightening/rotating instrument enabled for tightening/rotating (131) the tool (6) around the axial axis (62) thereof.

9. The system for opening locks according to claim 8, characterised in that the tool (6) has an end (63) opposite from the tip (61) thereof and enabled for tightening/rotating (131) the same tool (6) around the axial axis (62) thereof by means of the tightening/rotating instrument.

10. The system for opening locks according to claim 7, characterised in that it comprises an extraction instrument enabled for extracting (141) the cylinder (2) and/or rotor (3).

11. The system for opening locks according to claim 10, characterised in that the extraction instrument comprises a lever or crowbar or similar.

12. The system for opening locks according to claim 7, characterised in that the tool (6) has a stop (64) arranged in the region opposite from the tip (61) thereof.

13. The system for opening locks according to claim 7, characterised in that the impingement gun (7) is of the type commonly used for fastening or anchoring nails.

14. The system for opening locks according to claim 7, characterised in that the impingement gun (7) is detonating or powder-actuated.

15. The system for opening locks according to claim 7, characterised in that the impingement gun (7) is the result of introducing some modification and/or adaptation in an impingement gun of the type commonly used for fastening or anchoring nails.

* * * * *